US010472871B2

(12) United States Patent
Kellum, III

(10) Patent No.: US 10,472,871 B2
(45) Date of Patent: Nov. 12, 2019

(54) WINDOW BALANCE HAVING FOUR-LOOP CORD CONFIGURATION

(71) Applicant: Amesbury Group, Inc., Amesbury, MA (US)

(72) Inventor: Wilbur J. Kellum, III, Garretson, SD (US)

(73) Assignee: AMESBURY GROUP, INC., Amesbury, MA (US)

( * ) Notice: Subject to any disclaimer, the term of this patent is extended or adjusted under 35 U.S.C. 154(b) by 178 days.

(21) Appl. No.: 15/660,588

(22) Filed: Jul. 26, 2017

(65) Prior Publication Data

US 2018/0030767 A1 Feb. 1, 2018

Related U.S. Application Data

(60) Provisional application No. 62/366,940, filed on Jul. 26, 2016.

(51) Int. Cl.
*E05F 3/00* (2006.01)
*E05D 13/00* (2006.01)

(52) U.S. Cl.
CPC ..... *E05D 13/1207* (2013.01)

(58) Field of Classification Search
CPC ..... E05D 13/1207; E05D 13/04; E05D 13/08; E05D 13/00; E05Y 2201/67; E05Y 2900/148; E05Y 2201/668; E05Y 2900/00; E05Y 2201/688; Y10S 16/16; Y10T 16/6298; Y10T 16/84; Y10T 16/64; Y10T 16/635; Y10T 16/698; Y10T 16/63; Y10T 16/82; Y10T 16/73
USPC .... 49/447, 445, 446, 448; 16/197, 215, 401, 16/DIG. 16, 193, 199, 210, 216, 400
See application file for complete search history.

(56) References Cited

U.S. PATENT DOCUMENTS 2,262,990 A * 11/1941 Cross ..... E05D 13/1207 16/197
3,358,403 A * 12/1967 Dinsmore ..... E05D 13/1207 16/197
4,089,085 A * 5/1978 Fitzgibbon ..... E05D 13/1207 16/197
4,413,445 A * 11/1983 Trout ..... E05D 13/1207 49/445
4,697,304 A * 10/1987 Overgard ..... E05D 13/1207 16/198
5,530,991 A 7/1996 deNormand et al.
5,737,877 A 4/1998 Meunier et al.
6,041,476 A 3/2000 deNormand
6,467,128 B1 * 10/2002 Damani ..... E05D 13/1207 16/193

(Continued)

*Primary Examiner* — Chi Q Nguyen

(57) ABSTRACT

A window balance has a channel with two ends. A top guide is disposed at one end of the channel and a bottom guide is disposed at the other end of the channel. One end of a spring is fixed within the channel. A movable block is secured to the other end of the spring. Rollers are rotatably mounted in the movable block. A single roller is rotatably mounted to a fixed block which is secured to the channel. A cord exit roller is disposed proximate the bottom guide. The first end of a cord is fixed relative to the channel. The middle portion of the cord is routed about the rollers mounted in the movable block and mounted to the fixed block. A second end of the cord is routed around the cord exit roller and is attachable to a window jamb.

19 Claims, 12 Drawing Sheets

(56) References Cited

U.S. PATENT DOCUMENTS

| | | | | |
|---|---|---|---|---|
| 6,598,264 | B2 | 7/2003 | Newman | |
| 6,622,342 | B1 * | 9/2003 | Annes | E05D 13/08 16/193 |
| 6,877,187 | B2 | 4/2005 | Newman | |
| 7,069,621 | B2 * | 7/2006 | Malek | E05D 13/1207 16/194 |
| 7,155,778 | B2 | 1/2007 | Newman | |
| 7,353,567 | B2 | 4/2008 | Newman | |
| 7,669,284 | B2 | 3/2010 | Newman | |
| 7,735,192 | B2 | 6/2010 | deNormand | |
| 8,042,227 | B2 | 10/2011 | Newman | |
| 8,132,290 | B2 * | 3/2012 | Liang | E05D 13/1207 16/193 |
| 2002/0129463 | A1 * | 9/2002 | Newman | E05D 13/04 16/197 |
| 2003/0074764 | A1 * | 4/2003 | Pettit | E05D 13/1207 16/400 |
| 2008/0000047 | A1 * | 1/2008 | deNormand | E05D 13/1207 16/197 |
| 2014/0150346 | A1 * | 6/2014 | DeBoer | E06B 3/4415 49/414 |

* cited by examiner

WINDOW BALANCE HAVING FOUR-LOOP CORD CONFIGURATION

CROSS-REFERENCE TO RELATED APPLICATIONS

This application claims priority to and the benefit of U.S. Provisional Patent Application Ser. No. 62/366,940, filed Jun. 26, 2016, entitled "Window Balance Having Four-Loop Cable Configuration," the disclosure of which is hereby incorporated by reference herein in its entirety.

INTRODUCTION

Hung window assemblies generally include a window frame, a lower window sash, an upper window sash, a pair of window jambs, two sets of jamb pockets, and at least one window balance device for offsetting the weight of a window sash throughout a range of travel within the window frame. Typically, two balances are utilized for each movable window sash. Block and tackle window balance devices use a combination of a spring and pulleys located within a channel to balance the weight of the window sash at any position within the jamb pockets. In some block and tackle window balances, the channel containing both the spring and pulleys is attached to the window sash, and a cord, which connects the pulleys together, is attached to a jamb mounting hook that is connected to a side jamb.

SUMMARY

In one aspect, the technology relates to a window balance having: a channel having a first channel end and a second channel end; a top guide disposed at the first channel end; a bottom guide disposed at the second end; a spring having a first spring end fixed within the channel and a second spring end; a movable block secured to the second spring end; a fixed block secured to the channel; a plurality of rollers rotatably mounted in the movable block; a single roller rotatably mounted in the fixed block; a cord exit roller disposed proximate the bottom guide; and a cord having a first cord end fixed relative to the channel, a middle cord portion routed about the plurality of rollers and the single roller, and a second cord end portion routed around the cord exit roller, wherein the second cord end is attachable to a window jamb. In an example, the plurality of rollers are fixed relative to each other. In another example, the first spring end is secured to the top guide. In yet another example, the first spring end is secured to a rivet spanning the channel. In still another example, the cord exit roller is rotatably mounted to at least one of the fixed block and the bottom guide.

In another example of the above aspect, the fixed block and the bottom guide are a unitary part. In an example, the cord exit roller is rotatably mounted to the channel. In another example, the first cord end is secured to at least one of the fixed pulley, the bottom guide, and a rivet spanning the channel.

In another aspect, the technology relates to a window balance having: a channel having a first channel end and a second channel end; a spring having a first spring end fixed relative to the channel and a second spring end; a movable block secured to the second end of the spring; a first roller having a plurality of roller surfaces, wherein the roller is first rotatably mounted in the movable block; a fixed block secured to the channel; a second roller rotatably mounted to the fixed block; a bottom guide secured to the second channel end; a third roller rotatably mounted in the bottom guide; and a cord having: a first cord end secured to at least one of a rivet spanning the channel, the fixed block, and the bottom guide; a middle cord portion routed about the first roller and the second roller; and a second cord end portion routed around the third roller, wherein the second cord end is attachable to a window jamb. In an example, the fixed block and the bottom guide are a unitary part. In another example, the window balance includes a top guide secured to the first channel end. In yet another example, the first spring end is secured to the top guide. In still another example, the middle cord portion includes a plurality of wraps around the first roller.

In another example of the above aspect, each of the plurality of wraps are disposed about a different one of the plurality of roller surfaces. In an example, the second roller and the third roller are configured to rotate about substantially parallel axes. In another example, the first roller, the second roller, and the third roller are configured to rotate about substantially parallel axes. In yet another example, the second cord end terminates at a jamb mounting attachment. In still another example, the first cord end terminates at a hook. In another example, the window balance includes no more than three rollers.

In another aspect, the technology relates to a block and tackle window balance consisting essentially of three rollers.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
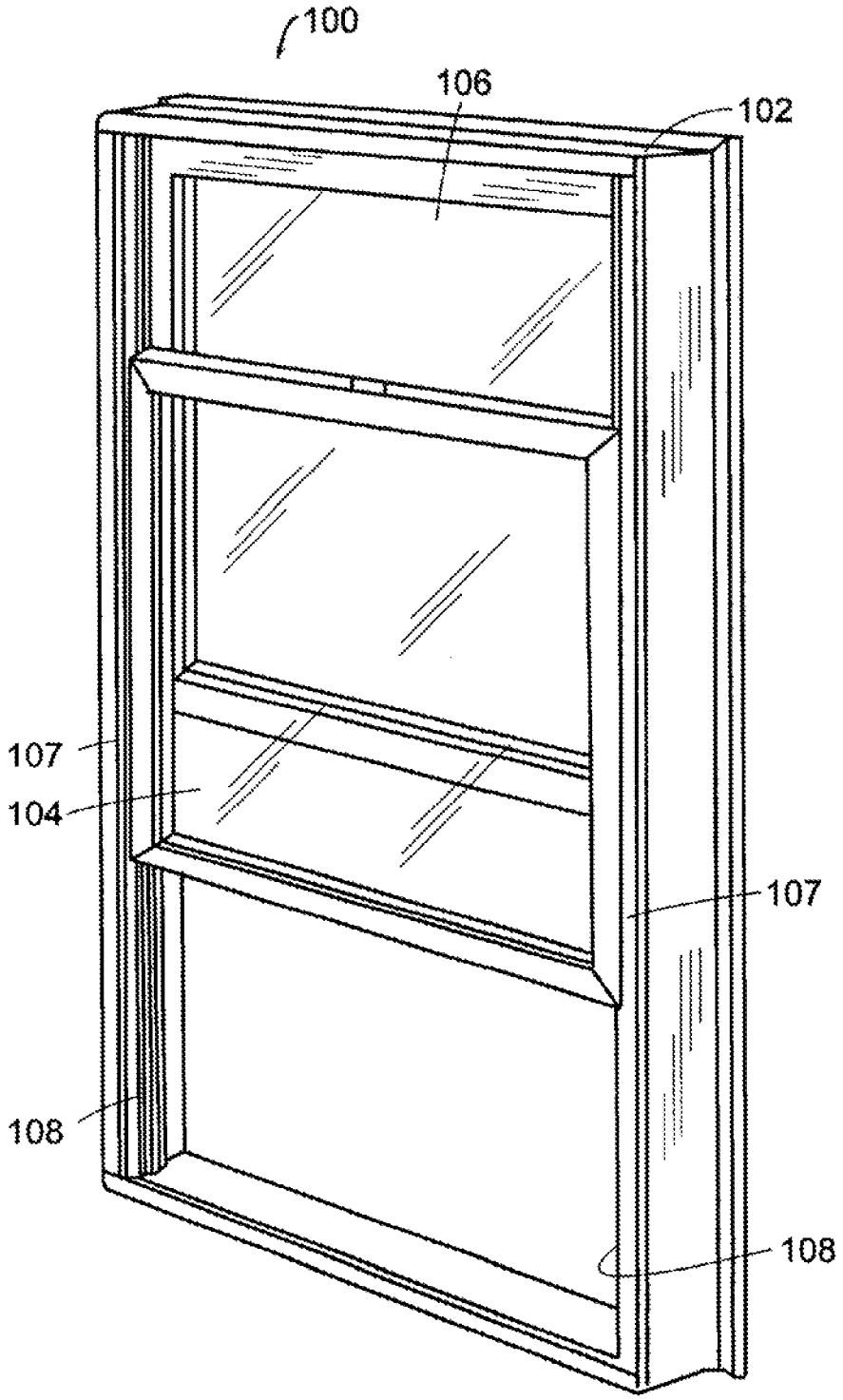
FIG. 1 is a perspective view of a hung window.

Referring to FIG. 1, shown is a hung window assembly 100 in which a block and tackle window balance constructed in accordance with the teachings of the present technology can be used. The hung window assembly 100 includes a window frame 102, a lower window sash 104, an upper window sash 106, and a pair of window jambs 107. Within each window jamb 107, jamb pockets 108 are defined. The lower window sash 104 and upper window sash 106 slide vertically within the jamb pockets 108 in a double-hung window. In a single-hung window, only one sash (typically, the lower sash 104) slides. Generally, two window balances are attached to each movable window sash 104, 106 (one on each side) to balance the weight of the window sashes at any vertical position within the jamb pockets 108.

Figure 2:
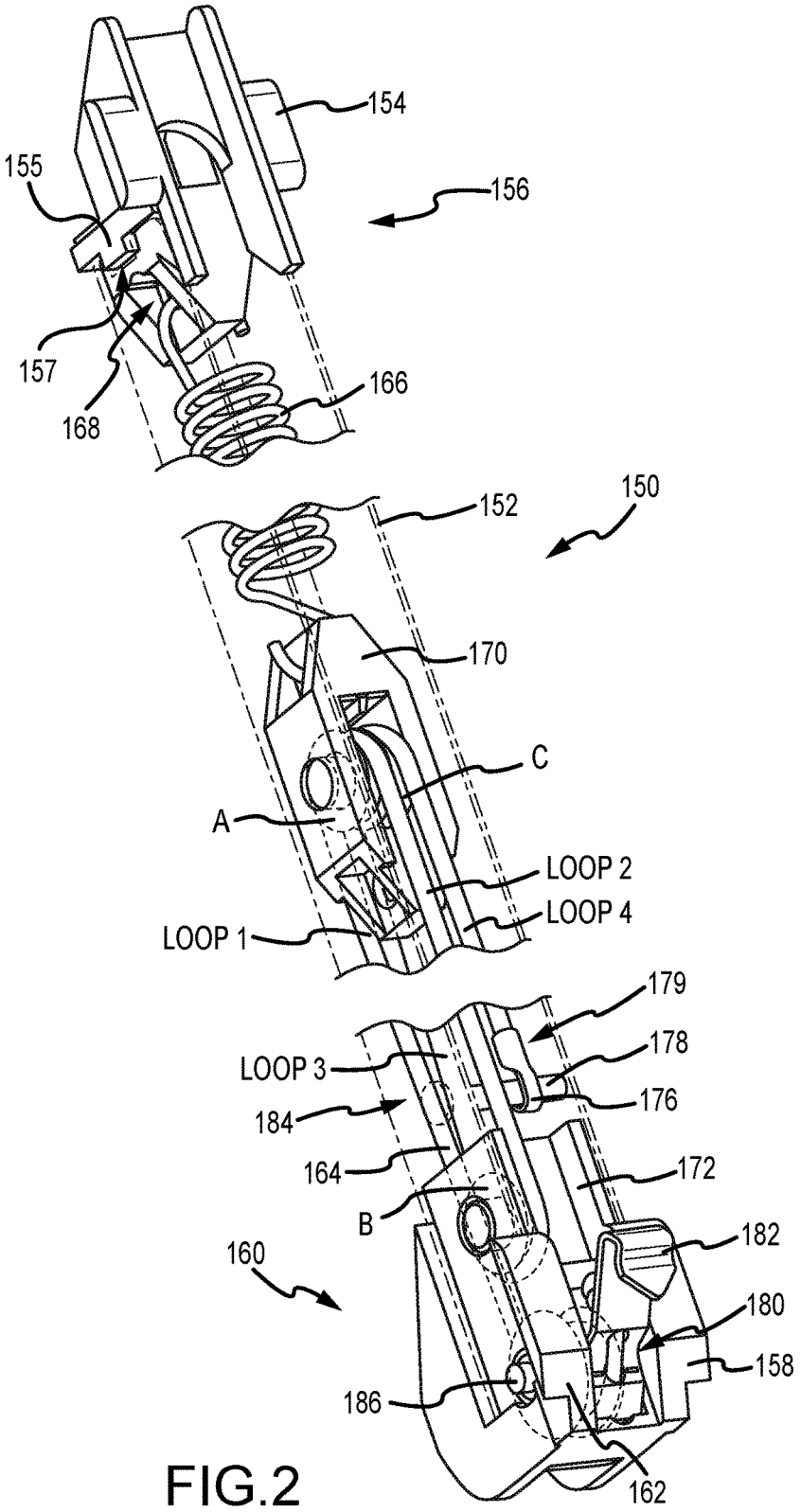
FIG. 2 depicts a partial front perspective view of an example of a block and tackle window balance.

FIG. 2 depicts a block and tackle window balance 150 in accordance with an example of the present technology. The window balance 150 includes a rigid U-shaped channel 152 (depicted in dashed lines) having a top guide 154 at an upper channel end 156 and a bottom guide 158 at a bottom channel end 160. The top guide 154 and bottom guide 158 engage with cams on a side of a window sash (such as that depicted in FIG. 1) so as to center the sash in the window frame. The top guide 154 includes projections 155 that fit within notches 157 in the top end 156 of the U-shaped channel 152. The bottom guide 158 includes a bottom guide roller 162 about which a cable or cord 164 is routed as it is pulled from the channel 150 during operation. As such, the bottom guide roller 162 may also be referred to as a cord exit roller, as it is the last roller that the cord 164 is routed around as it exits the channel 152. A spring 166 is connected, in the depicted figure, to an opening 168 in the top guide 154. In other examples, the spring 166 may be secured to a rivet or other anchor that spans or is otherwise secured to the channel 152. A moveable or translatable pulley block 170 is suspended from an opposite end of the spring 166, such that, as the spring 166 stretches, the movable pulley block 170 moves within the channel 152.

The cord 164 is routed between the translatable pulley block 170 and both of the bottom guide roller 162 and a fixed pulley block 172. A first end 174 of the cord 164 terminates at a terminal 176 (e.g., a hook, ring, or other anchoring element) that is secured to a rivet 178 or other secure element that is fixed relative to the channel 152. In another example, the terminal 176 may be directly connected to the fixed pulley block 172 or the bottom guide 162, for example, with a tie-off. A second end 180 of the cord 164 passes around the bottom guide roller 162 and terminates a jamb mounting hook 182, which is secured to a jamb of a window when the window balance 100 is installed in the window. The arrangement of the cord 164 (namely, the number of loops between the first end 174 and the second end 180) is described in more detail below. As used herein, a middle portion 184 of the cord 164 is that portion that is between the first end 174 and the second end 180 of the cord 164.

Starting at the jamb mounting hook 182 at the second end 180 of the cord 164, the middle portion 184 of the cord 164 first extends around the bottom guide roller 162 so as to enter the channel 152. The cord 164 extends from the bottom guide roller 162 as loop 1 before wrapping around pulley A in the moveable pulley block 170. Thereafter, the middle portion 184 of the cord 164 is routed from pulley or roller A to pulley or roller B in the fixed pulley block 172, so as to form loop 2 of the cord 164. The middle portion 184 of the cord 164 is then routed from pulley or roller B to pulley or roller C in the movable pulley block 170, so as to form loop 3 of the cord 164. Finally, loop 4 of the cord 164 extends from pulley or roller C to the terminal 176, which is again secured to the rivet 178. The term "loop" as used herein does not imply a curve that crosses itself; rather, the term "loop" is used to describe a length or span of the cord 164 that extends between the various rollers (and in the case of Loop 4, the terminal 178) described in the window balance 150.

In the window balance 150 depicted in FIG. 2, the bottom guide 158 is integral with the fixed pulley block 172 tension of the spring 166 and will keep the bottom guide 158 engaged with or connected to the rigid U-shaped channel 152. Additionally, an axle 186 about which the bottom guide roller 162 rotates extends from either side of the bottom guide 158. The axle 186 is sized such that each end fits within a notch on opposite sides of the second end 160 of the U-shaped channel 152. These notches, which are not visible in FIG. 2, are similar to the notches 157 that accommodate the projections 155 of the top guide 154. Thus, when assembled, the projections 155 of the top guide 154 are fitted within the top notches 157 and the axle 186 is fitted within the bottom notches. In this configuration, the spring 166 provides tension (via the cord 164) so as to hold both the top guide 154 and the bottom guide 158 securely to the U-shaped channel 152. Thus, those elements may be secured to the channel 152 without further fasteners. In other examples, such as those described below, these elements may be secured with fasteners such as rivets or adhesives. As depicted in FIG. 2, each of rollers A-C and the bottom guide roller 162 rotates about axes that are all substantially parallel to each other. This configuration is also utilized in the other window balances depicted herein.

Figure 3A:
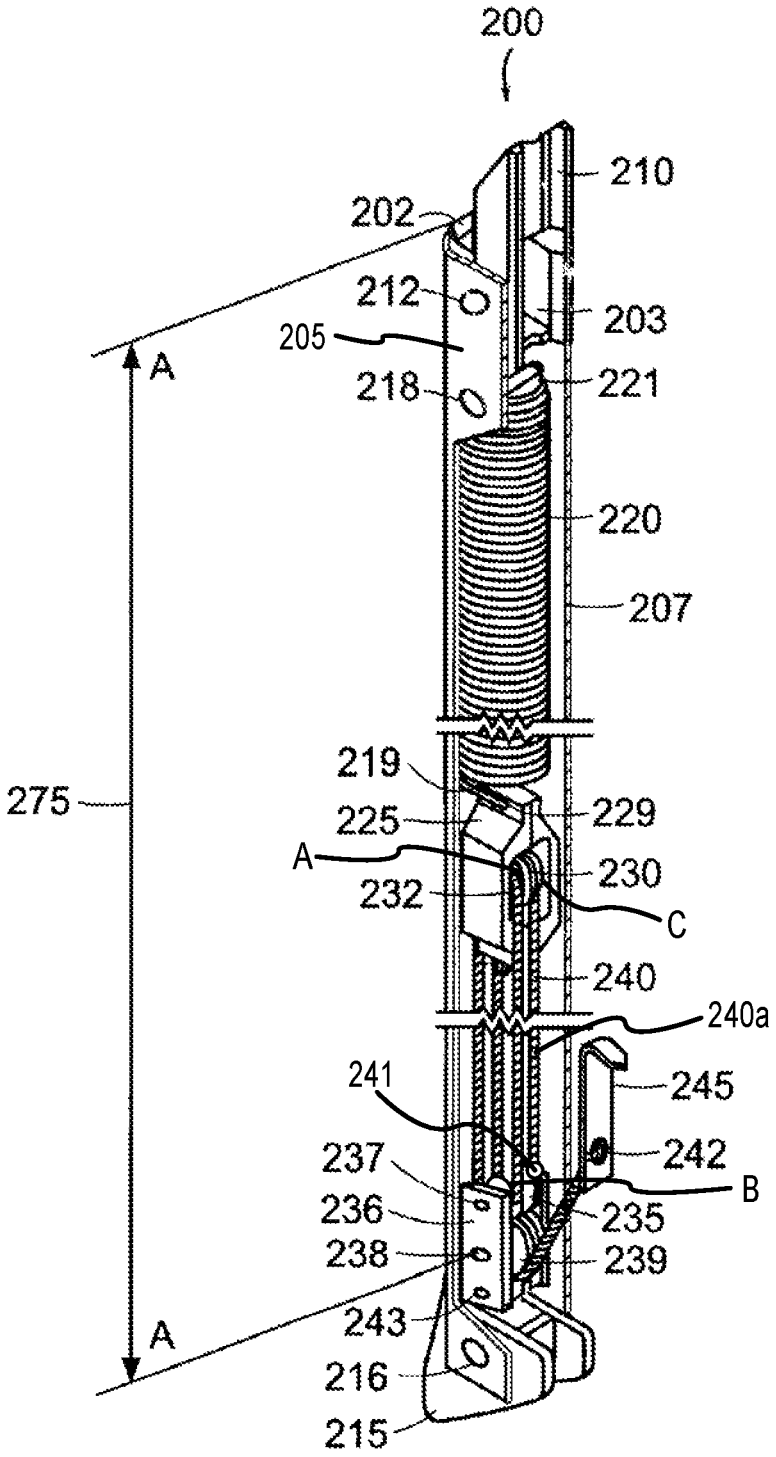
FIGS. 3A and 3B are partial front perspective and rear perspective views of another example of a block and tackle window balance.
Figure 3B:
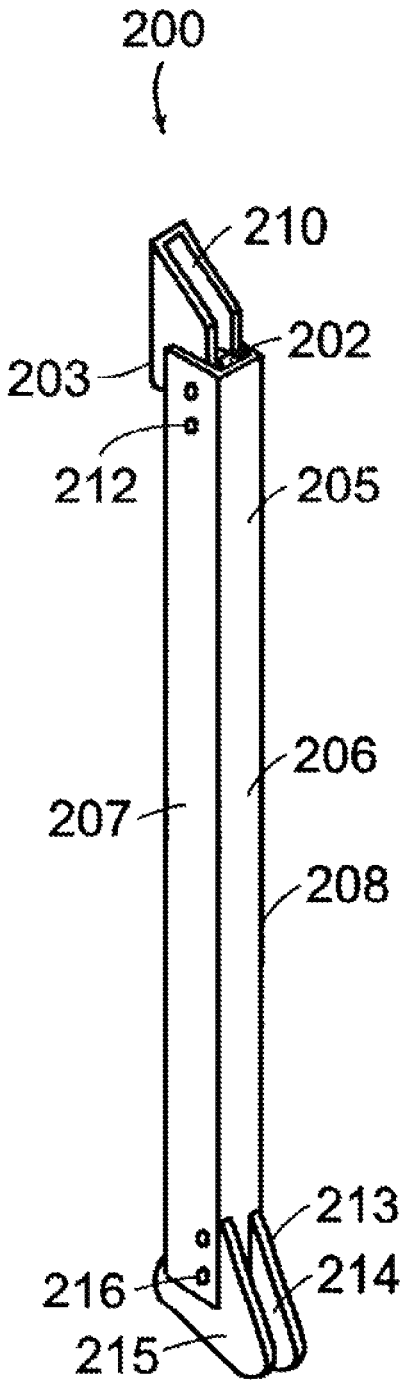

FIGS. 3A and 3B show front and rear perspective views of a block and tackle window balance 200 and are described concurrently. FIG. 3A shows the block and tackle window balance 200 with one side wall of a rigid U-shaped channel 205 cut away so that components within the window balance 200 are more visible. FIG. 3B shows a rear view of the window balance 200.

The block and tackle window balance 200 includes a spring 220, a translatable or movable pulley block 230, a fixed pulley block 235, a cord exit roller 239, and a cord 240 all housed with the rigid U-shaped channel 205. Attached to the two ends of the rigid U-shaped channel 205 with fasteners 212, 216 are a top guide 210 and a bottom guide 215 that are used to connect the window balance 200 to either the upper or lower window sashes 104, 106 and to help guide the vertical motion of the window balance 200 within the jamb pockets 108. The top guide 210 includes an upper portion 202 and a lower portion 203. The upper portion 202 of the top guide 210 is angled and is sized to be received by a member attached to a window sash, such as a cam. The bottom guide 215 includes a back portion 213, best seen in FIG. 3B, that encases a portion of the rigid channel 205. Within the back portion 213 of the bottom guide 215 is a channel 214 sized to receive a portion of a window sash.

The rigid U-shaped channel 205 has a back wall 206 and two side walls 207, 208 that in combination form the U-shape. The rigid U-shaped channel 205 serves as an external frame to which the components of the window balance 200 can be secured. The rigid U-shaped channel 205 also keeps components located within the rigid U-shaped channel 205 free of debris and particulate matter. The spring 220, the movable pulley block 230, the fixed pulley block 235, and the cord exit roller 239 are located inside the rigid U-shaped channel 205. The movable pulley block 230 includes two rollers C, A rotatable about a single roller axle 232. The fixed pulley block 235 includes a single roller B rotatable around an axle 237 and the cord exit roller 239. The cord exit roller 239 is disposed proximate the bottom guide 215, below roller B. The cord 240 is routed about the rollers A-C and the cord exit roller 239, as described in more detail below.

Components within the rigid U-shaped channel 205 work in combination to create a force to counterbalance the weight of the attached sash at any vertical position within the window frame 102. These components are attached to each other such that a first end 219 of the spring 220 is connected to the movable pulley block 230, and the movable pulley block 230 is connected to the fixed pulley block 235 and the cord exit roller 239 via the cord 240. The roller B and cord exit roller 239 in the fixed pulley unit 235 may be contained in a frame 236. To secure the components within the rigid U-shaped channel 205, the second end 221 of the spring 220 and the frame 236 are fixed to opposite ends of the rigid U-shaped channel 205 via respective fasteners 218, 243 (e.g., rivets that span the u-shaped channel 205). The frame 236 is also used to secure the axles 237 and 238, around which roller B and the cord exit roller 239 in the fixed pulley unit 235, respectively, rotate. A first distance "AA" 275 is defined by a length extending between the upper portion 202 of the top guide 210 and the cord exit roller axle 238. The spring 220 and the movable pulley block 230 are connected together by hooking the first end 219 of the spring 220 through an upper slot opening 229 in a frame 225. The frame 225 houses the movable pulley block 230 and a roller axle 232 around which rollers A, C in the movable pulley block 230 rotate. The cord 240, which can also be a rope, string, or cable, has a first end portion 241, a second end portion 242, and a middle portion 240*a*. The first end 241 of the cord 240 is secured to the fixed pulley block 235 with a hook or a knot. The middle portion 240*a* is wrapped around the rollers: first roller C, then roller B, then roller A, and forms a plurality of loops between the rollers A-C such as described above. The second end portion 242 is then wrapped around the cord exit roller 239 before being secured to a jamb mounting attachment 245. The jamb mounting attachment 245 engages an opening 430 (e.g., as depicted in FIG. 4B) within one of the jamb pockets 108, securing the window balance 200 to the window jamb 107.

The spring 220 provides the force required to balance the sashes. The spring 220 is extended when the second end 242 of the cord 240 with the jamb mounting attachment 245 is pulled, causing the frame 225 to move within the rigid U-shaped channel 205 towards the frame 236, which is fixed. As the frame 225 moves towards the frame 236, the spring 220 is extended.

Figure 4A:
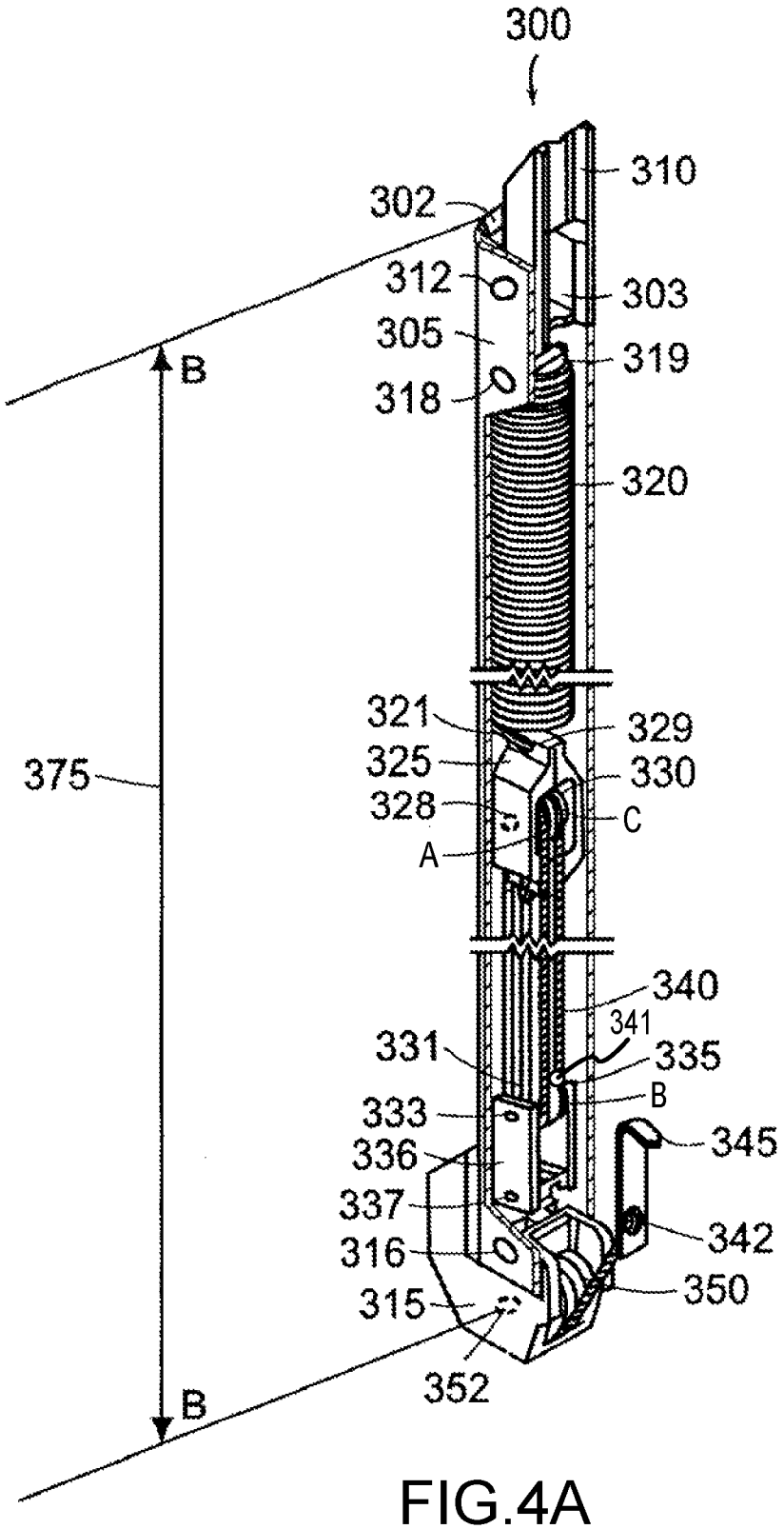
FIGS. 4A and 4B are partial front perspective and rear perspective views of another example of a block and tackle window balance.
Figure 4B:
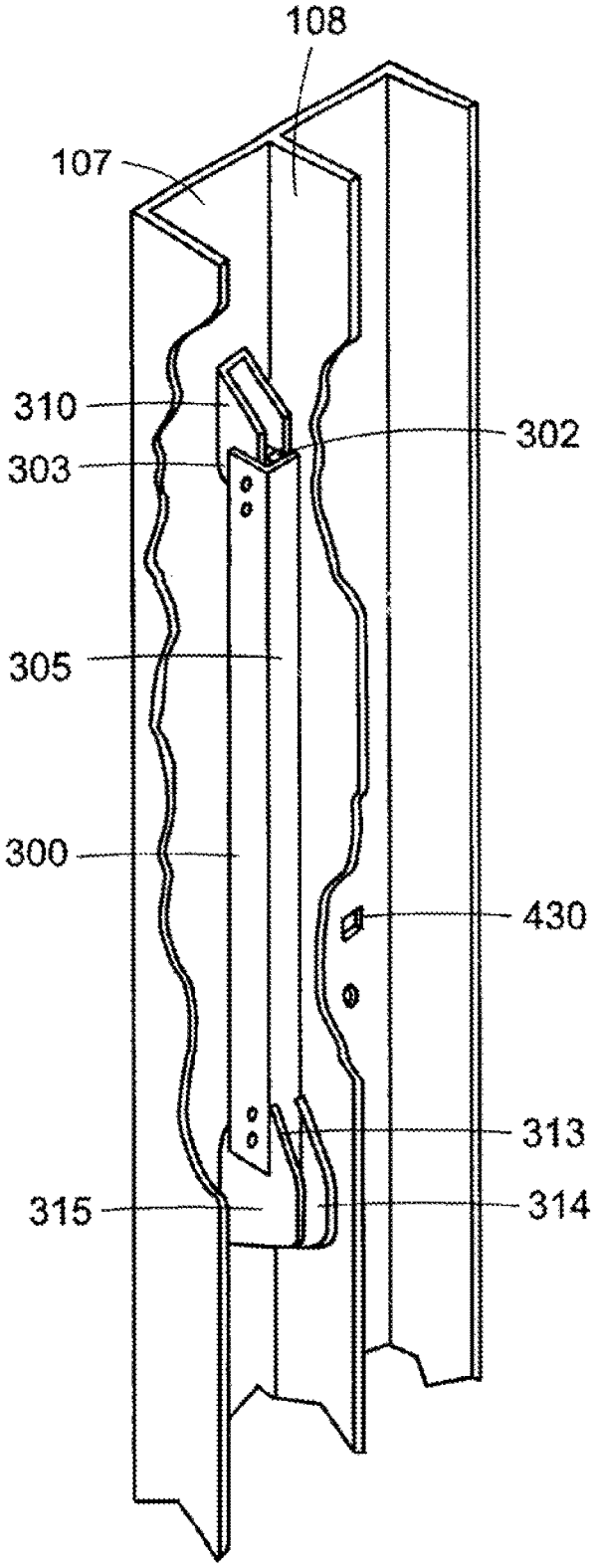

FIG. 4A depicts an example of a block and tackle window balance 300 in accordance with teachings of the present technology and depicts the balance 300 with a side wall of the rigid U-shaped channel 305 removed. The window balance 300 includes the rigid U-shaped channel 305, a top guide 310, a bottom guide 315, a spring 320, a translatable or movable pulley block 330, a fixed pulley block 335, a bottom guide cord exit roller 350, and a cord 340. The top guide 310 and the bottom guide 315 are fixed to the rigid U-shaped channel 305 by fasteners 312, 316. The top guide 310 is used to help connect the block and tackle window balance 300 to the window sash 104, 106 and to help guide the movement of the block and tackle window balance 300 within the jamb pocket 108. The top guide 310 may include a top angled portion 302 and a bottom portion 303. The bottom guide 315 is also used for connection and guidance purposes, but the bottom guide 315 further serves as a frame for housing the bottom guide or roller cord exit roller 350. The bottom guide 315 extends beyond the rigid U-shaped channel 305 and, therefore, the cord exit roller 350 is located outside of the rigid U-shaped channel 305. A back portion 313 of the bottom guide 315 may include a channel 314 for receiving a portion of the window sash, as depicted in FIGS. 4A and 4B. Some windows have a groove running along a bottom rail of the sash. On conventional balances, the bottom guide can drop into this groove so a manufacturer needs to use a shorter balance to avoid dropping into the groove. This effectively reduces the amount of travel, because shorter balances have to be used. The bottom guide 315 depicted in FIG. 4 is configured so the contact point of the bottom guide 315 to the sash is higher on the balance 300 so the groove is avoided and a longer balance with a greater spring force can be used. This can afford increased force for balancing the sash at any vertical position, as well as increased amount of travel resulting from the longer balance.

The spring 320, the movable pulley block 330, and the fixed pulley block 335 are located within the rigid U-shaped channel 305. In the example depicted in FIG. 4A, the movable pulley block 330 includes two pulleys or rollers A, C that are rotatable about a single pulley axle 328. Similarly, the fixed pulley block 335 includes a pulley or roller B that rotates about a single pulley axle 333. A first end 319 of the spring 320 is fixed with respect to the rigid U-shaped channel 305 via a fastener 318. In the disclosed embodiment, the fastener is a rivet; however the fastener could also be a support member welded between the two side walls of the rigid U-shaped channel 305, a hook secured to or formed in the rigid U-shaped channel 305, or any other device which secures the first end 319 of the spring 320 to the rigid U-shaped channel 305. The second end 321 of the spring 320 is attached to a frame 325, which houses the movable pulley block 330. To connect the spring 320 to the frame 325, the second end 321 of the spring 320 hooks through an opening 329 in the frame 325. The cord 340 has a first end 341 and a second end 342. The first end portion 341 of the cord 340 is attached to the fixed pulley block 335 through a frame opening 322. The second end portion 342 is attached to a jamb mounting hook 345. The middle portion 340*a* of the cord 340 is threaded through the movable pulley block 330, the fixed pulley block 335, and around the bottom guide cord exit roller 350, connecting the three components together. Specifically, the middle portion 340*a* is routed around roller C, then roller B, then roller A, then around the cord exit roller 350. The cord 340 in the disclosed embodiment may also be a string, a rope, or a cable. Both the fixed pulley block 335 and the bottom guide cord exit roller 350 are fixed with respect to the rigid U-shaped channel 305. The fixed pulley block 335 is housed within a frame 336 and rotates around the pulley axle 333. The frame 336 is secured within the rigid U-shaped channel 305 with a fastener 337. The bottom guide cord exit roller 350 is located within the bottom guide 315 and rotates around a bottom guide axle 352. A second distance "BB" 375 is defined as the length extending between the top angled portion 302 of the top guide 310 and the bottom guide axle 352. It should be noted that the second distance "BB" 375 is greater than the first distance "AA" 275 of the window balance 200.

To use the block and tackle window balance 300 within the window assembly, the balance is connected to both the window jamb 107 and to either the lower window sash 104 or the upper window sash 106. Referring to FIG. 4B, the block and tackle window balance 300 is attached to the window jamb 107 via the jamb mounting hook 345. The jamb mounting hook 345 is secured within an opening 430 within the jamb pocket 108. The window balance 300 is then connected to a window sash by inserting a portion of the window sash into the channel 314 of the bottom guide 315 and connecting a cam 405 mounted on the top of the window sash 400 to the top angled portion 302 of the top guide 310. The block and tackle window balance 200 depicted in FIGS. 2A and 3B may be installed similarly.

The larger distance "BB" 375 corresponds to so-called "extended travel" block and tackle window balances as described generally in U.S. Pat. No. 6,598,264, entitled "Block and Tackle Window Balance with Bottom Guide Roller," the disclosure of which is hereby incorporated by reference herein in its entirety. Such block and tackle window balances are called "extended travel" window balances because they allow a window to be opened a larger distance than the "standard travel" window balances depicted in FIGS. 3A and 3B. The technologies described herein may be utilized in both the extended travel and standard travel window balances. Additionally, the technologies described herein may be utilized in window balances having unitary or separate bottom guides and fixed pulley blocks. Such technologies are described in further detail below.

Figure 5:
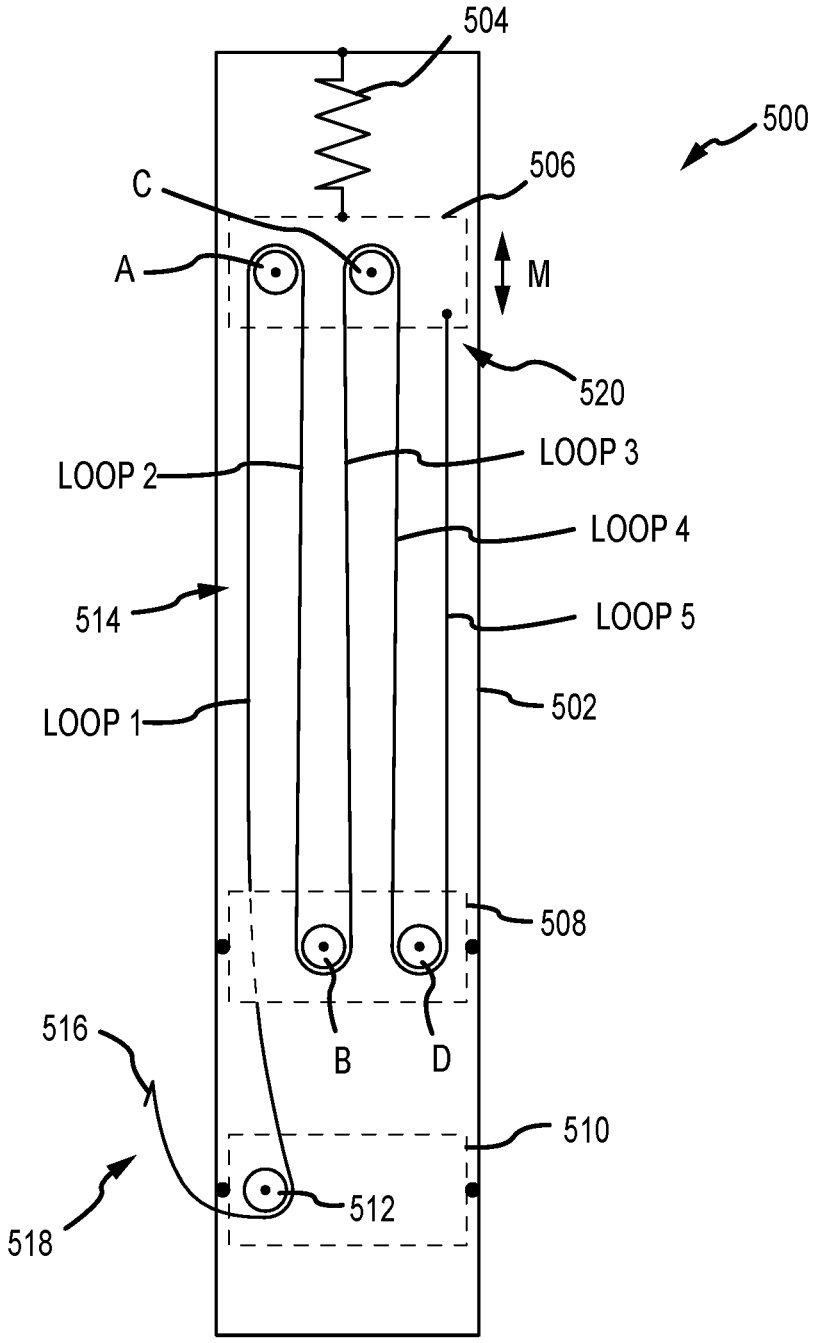
FIG.5 PRIOR ART
FIG. 5 depicts a schematic view of a prior art block and tackle window balance.

FIG. 5 depicts a schematic view of a prior art block and tackle window balance 500, specifically, a block and tackle window balance having a five-loop configuration. The prior art window balance 500 includes a U-shaped channel 502. The positions of the components therein are depicted schematically, but a spring 504 is fixed at one end to the channel 502 and fixed at a second end to a translatable or movable pulley block 506. As described above, this movable pulley block 506 is configured to move M within the U-shaped channel 502. The movable pulley block 506 includes two pulleys or rollers A, C that are configured to rotate independent of each other. A fixed pulley block 508 is also depicted as secured to the U-shaped channel 502. Two pulleys or rollers B, D are rotatably mounted independent of each other in the fixed pulley block 508. Further, a bottom guide 510 includes a cord exit roller 512 and is secured to the U-shaped channel 502. A cord 514 forms loops between the various depicted components. A jamb mounting attachment 516 is connected to a first end 518 of the cord 514. The cord 514 is first routed about the cord exit roller 512, then forms Loop 1 before passing around pulley or roller A. The cable 514 forms Loop 2 between roller A and roller B in the fixed pulley block 508, then forms Loop 3 as it passes to roller C. Passing around roller C, the cord then forms Loop 4 as it passes to roller D. Thereafter, Loop 5 is formed before the second end 520 of the cord 514 is secured to the moving pulley block 506.

Figure 6:
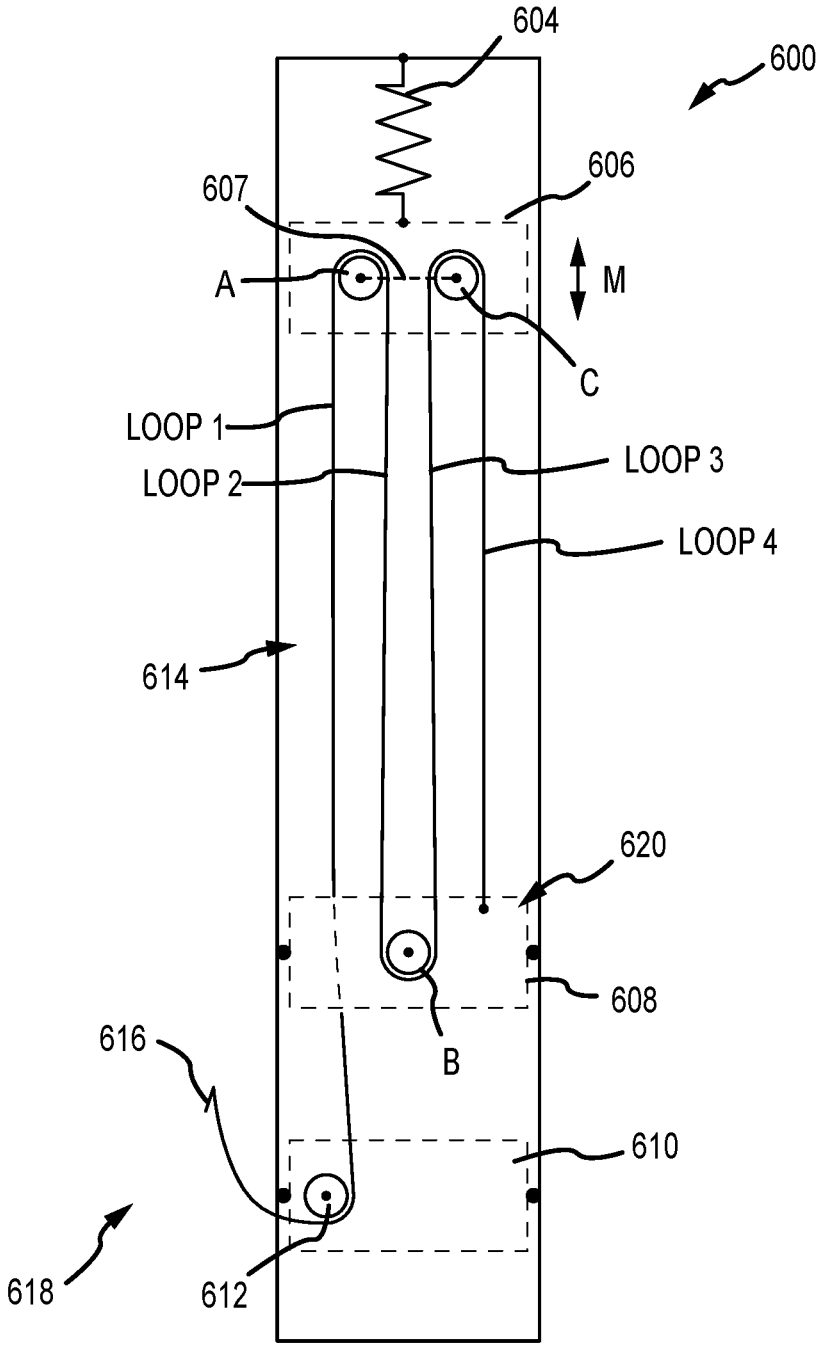
FIG. 6 depicts a schematic view of a block and tackle window balance in accordance with the present technology.

FIG. 6 depicts a schematic view of a block and tackle window balance 600, in accordance with the present technology. Specifically, the block and tackle window balance 600 has a four-loop configuration. The window balance 600 includes a U-shaped channel 602. The positions of the components therein are depicted schematically, but a spring 604 is fixed at one end to the channel 602 and fixed at a second end to a translatable or movable pulley block 606. This movable pulley block 606 is configured to move M within the U-shaped channel 602. The movable pulley block 606 includes two pulleys or rollers A, C that in the depicted example are configured to rotate together. As such, the rollers A, C are depicted connected by a common axle 607 to which both rollers A, C are fixed. In other examples, a single roller may be used, where the single roller has two different roller surfaces about which a cord 614 is wrapped. In yet another example, two rollers A, C may be fused to each other so as to rotate together. A fixed pulley block 608 is also depicted as secured to the U-shaped channel 602, and single roller B is rotatably mounted therein. Further, a bottom guide 610 includes a cord exit roller 612 and is secured to the U-shaped channel 602. In another example, the bottom guide 510 may be unitary with the fixed pulley block 508. The cord 614 forms loops between the various depicted components. A jamb mounting attachment 616 is connected to a first end 618 of the cord 614. The cord 614 is first routed about the cord exit roller 612, then forms Loop 1 before passing around pulley or roller A. The cable 614 forms Loop 2 between roller A and roller B in the fixed pulley block 608, then forms Loop 3 as it passes to roller C. Passing around roller C, the cord then forms Loop 4 as it passes to the fixed pulley block 608 to which the second end 620 is connected.

By reducing the number of loops between the fixed pulley block and the moveable pulley block, from the five loops depicted in FIG. 5, significant advantages in window balance performance and manufacture may be attained. For example, due to the use of four loops in the present technology (FIG. 6) instead of the typical five (FIG. 5), a lighter (and potentially lower cost) spring may be utilized while maintaining required balance performance. For example, when used in a balance having a four-loop cable configuration, as opposed to a five-loop configuration, the spring need only produce four-fifths of the force produced by the spring in the five-loop configuration. The use of the lighter spring also reduces the balance operating forces, and thus reduces stress on the other components within the balance (e.g., the top and bottom guides, cables, rivets, etc.). As such, performance is improved and cycle life extended. Additionally, use of a single roller in the fixed pulley block reduces costs associated with the manufacture thereof. Additionally, the four-loop configuration is suitably applicable to counterbalancing a range of window weights when combined with a fused roller or a single roller having multiple roller surfaces in the movable pulley block. In examples, the fused roller includes the two rollers located in the movable pulley block, formed into a single rotating element, so as to increase friction within the cord system. This discovery of the advantages of the fused pulley set makes it possible to achieve improved performance of the four-loop cord configuration.

Figure 7:
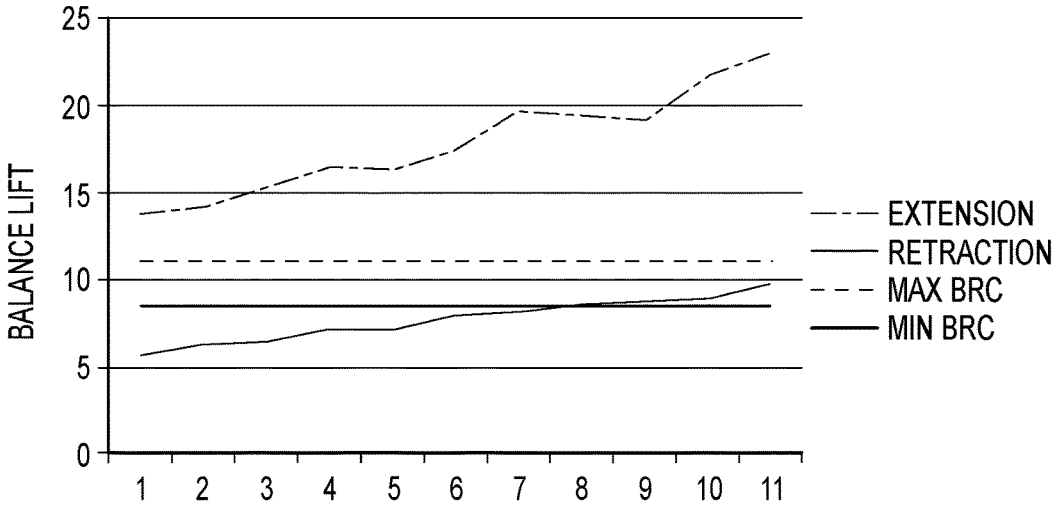
FIGS. 7-9 depict spring force plots for window balances.
Figure 8:
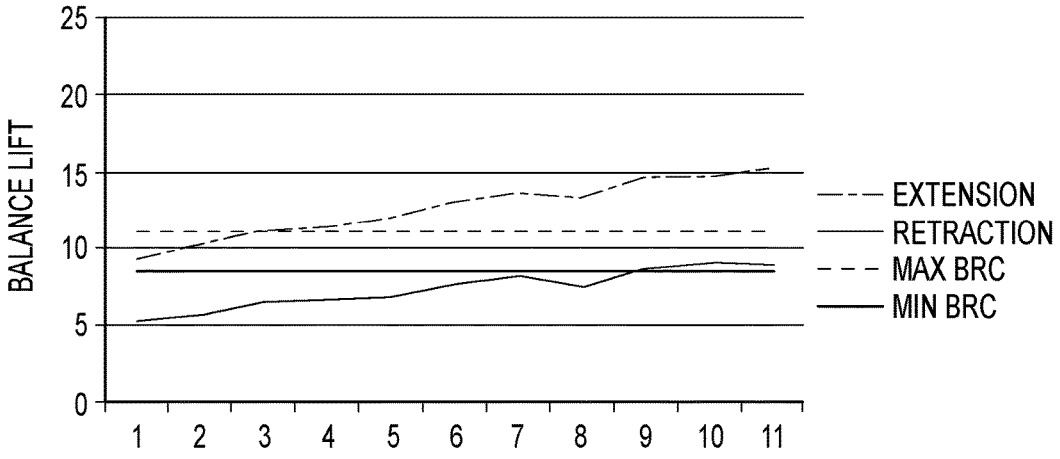
Figure 9:
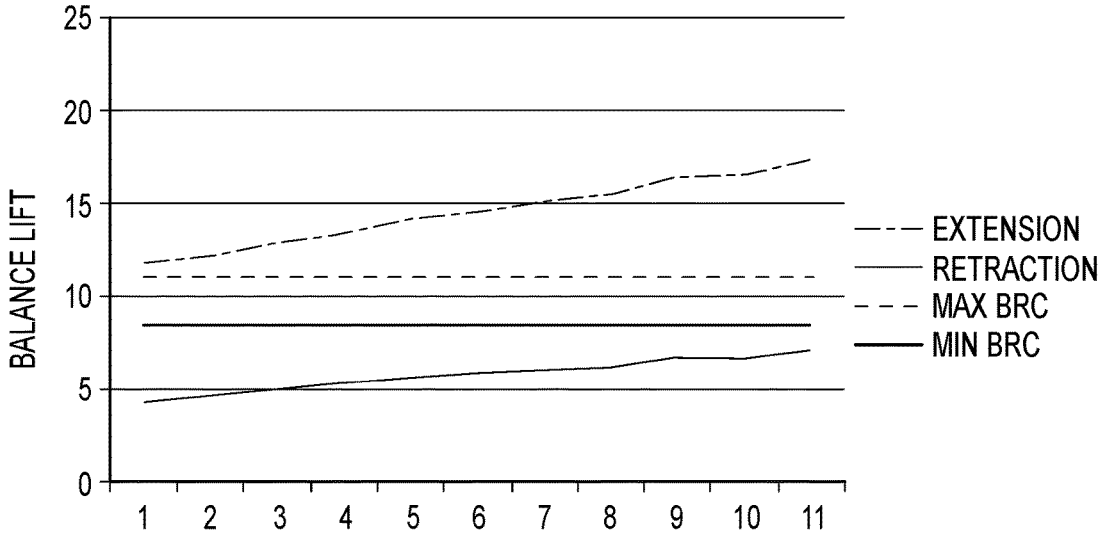

As compared to a five-loop configuration, a four-loop configuration requires the use of different components. That is, replacing the five-loop cord configuration in an existing balance with a four-loop configuration is not a simple matter of re-wrapping the cord so as to have four loops between the pulleys. As an example, FIGS. 7-9 depict spring force plots for window balances, specifically, the 706 Series 26C balance, available from Amesbury Group, Inc., of Sioux Falls, S. Dak., with different configurations of components therein. The vertical axes depict the force generated in pounds. The horizontal axes depict discrete data measurement points along the range of travel of the balance.

In the following plots, the line labeled EXTENSION refers to the force provided by the balance during extension thereof (that is, during closing of the window). The left end of the EXTENSION line depicts the force as closing of the window begins, from a fully-open position. The right end of the EXTENSION line depicts the force at complete closure of the window. The line labeled RETRACTION refers to the force provided by the balance during retraction thereof (that is, during opening of the window). The right end of the RETRACTION line depicts the force as opening of the window begins from the fully-closed position. The left end of the RETRACTION line depicts the force at complete opening of the window. MAX BRC refers to the Maximum Balance Rated Capacity (that is, one-half of the highest sash weight for which the balance is rated). MIN BRC refers to the Minimum Balance Rated Capacity (that is, one-half of the lowest sash weight for which the balance is rated). The effect of friction (e.g., due to the sash sliding against weatherstripping) is not depicted in the plots. The effect of friction generally, however, would be to raise the MIN BRC line and to lower the MAX BRC line.

For example, FIG. 7 depicts the performance of the 706 Series 26C balance, unmodified. That is, the balance has five loops, and free spinning rollers at all roller locations as is typical for block and tackle window balances. Such a balance is depicted schematically in FIG. 5. As can be seen, the balance produces about 13.7 pounds at the start of extension of the balance and about 22.9 pounds at the end of extension thereof. The end force (when the window is fully closed) is important because lower forces required to completely close the window are generally desirable by customers. Additionally, industry standard setting bodies, e.g., AAMA, require closing forces for residential windows to be less than about 30 pounds. At the start of retraction (that is, as opening of a fully-closed window begins), the balance produces about 9.8 pounds of force, with about 5.7 pounds at the end of retraction. Typically, a RETRACTION force in excess of the MIN BRC would cause the window to hop upward as opening of the window begins (that is, at the right side of the plot). However, this does not occur because of the friction produced on the window by the weatherstripping. Notably, both the EXTENSION and RETRACTION lines are not smooth (especially the EXTENSION line), which can lead to perceived changes in force during lifting and lowering of the window sash. Although not critical to performance, this may give a user an impression of poor performance that may cause the user to think the window is performing in a manner that is undesirable.

FIG. 8 depicts the performance of the 706 Series 26C balance, modified to utilize a four-loop cord configuration, as opposed to the five-loop configuration, with free spinning rollers at all roller locations. Such a balance is depicted schematically in FIG. 6, but with common axle 601 between roller A and C absent. The performance of the balance due to the change from a four-loop configuration to a five-loop configuration is considerable and problematic. As can be seen, at the start of extension of the balance, the EXTENSION force generated is less than the MAX BRC. In the case of a double-hung window, where both upper and lower sashes are movable, this can cause the upper sash to drop once the sash lock is released. Although the EXTENSION force to close the window is considerably lower than the five loop configuration of FIG. 7, the EXTENSION line is also not smooth, resulting in similar perceived performance problems. At the start of retraction, the RETRACTION force is in excess of the MIN BRC, but this amount is not considerable, given the effect of friction on the window. Nevertheless, such conditions, where the EXTENSION line is lower than the MAX BRC, and the RETRACTION line exceeds the MIN BRC, is referred to as an "upside down" balance, and is undesirable from a performance standpoint. As such, upward hopping movement of the window is unlikely. Notably, however, the RETRACTION line is also not smooth, which can again lead to perceived poor performance on the part of the user.

As such, it is clear from FIGS. 7 and 8 that simply changing from a five-loop to a four-loop configuration is insufficient to produce a desirable balance. The inventors have discovered that, by adding friction to the system, a desirable four-loop configuration can be achieved and performance can be otherwise improved. Adding friction between the movable window sash and the frame (e.g., at the weather stripping) is generally undesirable and impractical, however, since this may cause damage or wear on the sash or weather stripping. FIG. 9 depicts the performance of the 706 Series 26C balance modified to have four loops and, additionally, a fused pulley set disposed in the moveable pulley block (that is Pulley A and Pulley C are fused so as to rotate together). This has been discovered by the inventors to add sufficient friction to the balance so as to markedly change performance from that depicted in FIG. 3. As can be seen in FIG. 4, the modified balance produces about 11.0 pounds at the start of extension of the balance and about 17.3 pounds at the end of extension thereof (as depicted by the EXTENSION line). This reduction in end force is considerable lower than that of the unmodified balance and is very much desired by consumers. At the start of retraction, the balance produces about 7.1 pounds of force (that is the force to lift the balance is much lower than the unmodified balance), with about 4.3 pounds at the end of retraction. Additionally, the EXTENSION and RETRACTION lines are considerably spaced apart from the MAX BRC and MIN BRC, respectively, thus eliminating the potential for window drop and hopping. Moreover, both the EXTENSION and RETRACTION lines are considerably smoother than the prior configurations, thus improving customer perception and acceptance of the balance.

Figure 10:
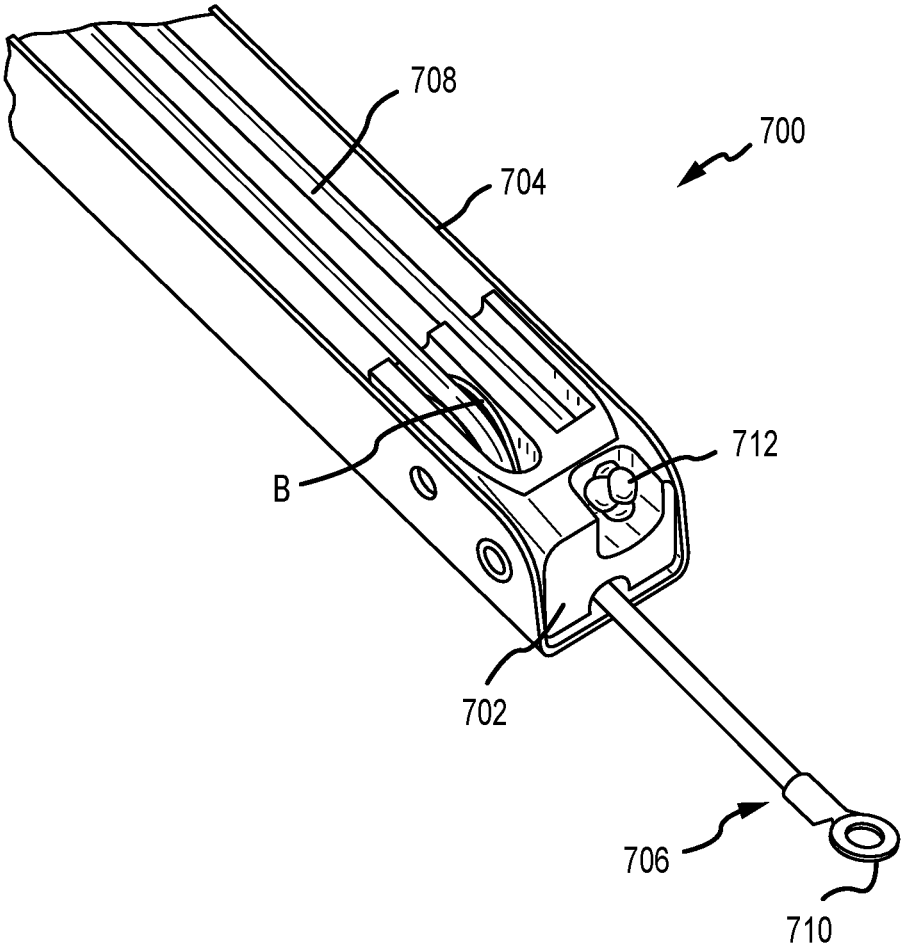
FIG. 10 depicts a partial perspective view of another example of a block and tackle window balance.

FIG. 10 depicts a partial perspective view of another example of a block and tackle window balance 700. Although standard block and tackle balances that utilize a bottom guide roller are depicted in the above figures, the proposed technology may also be utilized in conjunction with inverted block and tackle balances 700 (such as tilt-type balances) that do not include a bottom guide roller. As such, the technology may be utilized in both non-inverted and inverted block and tackle window balances. In the inverted window balance 700, the bottom guide roller is not utilized, while two rollers are disposed in the movable block and a single roller B is disposed in the fixed block 702 that is secured to the U-shaped channel 704. As with the embodiments depicted above, a first end 706 of the cord 708 is secured to a jamb mounting attachment 710, while the second end 712 of the cord is secured to or proximate the fixed pulley block 702.

The materials utilized in the balances described herein may be those typically utilized for window balance manufacture. Material selection for most of the components may be based on the proposed use of the window. Appropriate materials may be selected for windows subject to certain environmental conditions (e.g., moisture, corrosive atmospheres, etc.). Aluminum, steel, stainless steel, or composite materials can be utilized.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A window balance comprising:

a channel having a first channel end and a second channel end;

a top guide disposed at the first channel end;

a bottom guide disposed at the second channel end;

a spring having a first spring end fixed within the channel and a second spring end;

a movable block secured to the second spring end;

a fixed block secured to the channel;

a plurality of rollers rotatably mounted in the movable block;

a single roller rotatably mounted in the fixed block;

a cord exit roller disposed proximate the bottom guide; and a cord having a first cord end fixed relative to the channel, a middle cord portion routed about the plurality of rollers and the single roller, and a second cord end routed around the cord exit roller, wherein the second cord end is attachable to a window jamb.

2. The window balance of claim 1, wherein the plurality of rollers are fixed relative to each other.

3. The window balance of claim 1, wherein the first spring end is secured to the top guide.

4. The window balance of claim 1, wherein the first spring end is secured to a rivet spanning the channel.

5. The window balance of claim 1, wherein the cord exit roller is rotatably mounted to at least one of the fixed block and the bottom guide.

6. The window balance of claim 5, wherein the fixed block and the bottom guide comprise a unitary part.

7. The window balance of claim 1, wherein the cord exit roller is rotatably mounted to the channel.

8. The window balance system of claim 1, wherein the first cord end is secured to at least one of the fixed block, the bottom guide, and a rivet spanning the channel.

9. A window balance comprising:

a channel having a first channel end and a second channel end;

a spring having a first spring end fixed relative to the channel and a second spring end;

a movable block secured to the second end of the spring;

a first roller having a plurality of roller surfaces, wherein the first roller is first rotatably mounted in the movable block;

a fixed block secured to the channel;

a second roller rotatably mounted to the fixed block;

a bottom guide secured to the second channel end;

a third roller rotatably mounted in the bottom guide; and a cord having:

a first cord end secured to at least one of a rivet spanning the channel, the fixed block, and the bottom guide;

a middle cord portion routed about the first roller and the second roller; and a second cord end routed around the third roller, wherein the second cord end is attachable to a window jamb.

10. The window balance of claim 9, wherein the fixed block and the bottom guide comprise a unitary part.

11. The window balance of claim 9, further comprising a top guide secured to the first channel end.

12. The window balance of claim 11, wherein the first spring end is secured to the top guide.

13. The window balance of claim 9, wherein the middle cord portion comprises a plurality of wraps around the first roller.

14. The window balance of claim 13, wherein each of the plurality of wraps is disposed about a different one of the plurality of roller surfaces.

15. The window balance of claim 9, wherein the second roller and the third roller are configured to rotate about substantially parallel axes.

16. The window balance of claim 9, wherein the first roller, the second roller, and the third roller are configured to rotate about substantially parallel axes.

17. The window balance of claim 9, wherein the second cord end terminates at a jamb mounting attachment.

18. The window balance of claim 9, wherein the first cord end terminates at a hook.

19. The window balance of claim 9, further comprising no more than three rollers.

* * * * *